US005409879A

United States Patent [19]

Ueno et al.

[11] Patent Number: 5,409,879

[45] Date of Patent: Apr. 25, 1995

[54] REVERSIBLE THERMAL RECORDING MEDIUM

[75] Inventors: Takayoshi Ueno, Osaka; Masaaki Suzuki; Yoshio Kishimoto, both of Hirakata, all of Japan

[73] Assignee: Matsushita Electric Industrial Co., Ltd., Osaka, Japan

[21] Appl. No.: 123,479

[22] Filed: Sep. 20, 1993

[30] Foreign Application Priority Data

| | | | |
|---|---|---|---|
| Sep. 21, 1992 | [JP] | Japan | 4-250987 |
| Feb. 26, 1993 | [JP] | Japan | 5-037650 |
| Mar. 18, 1993 | [JP] | Japan | 5-058240 |
| Jun. 10, 1993 | [JP] | Japan | 5-138190 |

[51] Int. Cl.[6] ..... B41M 5/30

[52] U.S. Cl. ..... 503/201; 503/207; 503/214

[58] Field of Search ..... 503/201, 207, 214

[56] References Cited

U.S. PATENT DOCUMENTS

| | | | |
|---|---|---|---|
| 4,917,948 | 4/1990 | Hotta | 428/335 |

FOREIGN PATENT DOCUMENTS

| | | | |
|---|---|---|---|
| 0429010 | 5/1981 | European Pat. Off. | 503/201 |
| 0302374 | 2/1989 | European Pat. Off. | 503/201 |
| 4019683 | 1/1991 | Germany | 503/201 |
| 5-51470 | 3/1993 | Japan | 503/201 |
| 5-96853 | 4/1993 | Japan | 503/201 |

*Primary Examiner*—Pamela R. Schwartz
*Attorney, Agent, or Firm*—Fish & Richardson

[57] ABSTRACT

The reversible thermal recording medium of the invention is composed by forming on a substrate a porous reversible thermal recording layer which reversibly shows transparent states and opaque states by cooling after two modes of heating, by means of organic crystal particles dispersed in matrix polymer. One method for manufacturing a reversible thermal recording medium of the invention includes a coating step for applying a paint in which a matrix polymer, organic crystal particles and pore forming particles are contained and at least one of matrix polymer and organic crystal particles is dispersed in a granular form on a substrate to form a coating layer; plus a solvent contact step of eluting the pore forming particles by causing the coating layer to come into contact with a solvent in which the pore forming particles are soluble; and a drying step. Another method for manufacturing the reversible thermal recording medium of the invention includes a coating step of applying a paint in which a matrix polymer and organic crystal particles are contained and at least one of matrix polymer and organic crystal particles is dispersed in a granular form on a substrate to form a coating layer; plus a solvent contact step of causing the coating layer to come into contact with a solvent capable of dissolving the matrix polymer and organic crystal particles; and a drying step.

7 Claims, 6 Drawing Sheets

7
3
EVAPORATION OF WATER FILLING OF PARTICLES
SOLVENT CONTACT STEP DRYING STEP 4B
2
3

SOLVENT CONTACT STEP, DRYING STEP
FUSION OF PARTICLES MUTUAL DIFFUSION OF POLYMER 2
3
SOLVENT CONTACT STEP, DRYING STEP

EVAPORATION OF WATER
FILLING OF PARTICLES

FUSION OF PARTICLES
MUTUAL DIFFUSION OF POLYMER

REVERSIBLE THERMAL RECORDING MEDIUM

FIELD OF THE PRESENT INVENTION

The present invention relates to a reversible thermal recording medium capable of recording and erasing information reversibly by heating, and a method and apparatus for manufacturing the same.

BACKGROUND OF THE INVENTION

As recording materials capable of recording and erasing information reversibly, photochromic materials which form or eliminate colors by irradiation with light such as spiropyran compounds have hitherto been widely studied. These materials had, however, problems in stability to light or heat, and durability in repeated use.

By contrast, as materials with light resistance that can be used repeatedly, for example, Japanese Laid-open Patent Application Sho. 54-119377 discloses organic crystal particles dispersed in a matrix polymer, in which the recording material is changed in phase by heat to form transparent states and opaque states, thereby recording and displaying the information reversibly.

This reversible thermal recording material obtained by dispersing organic crystal particles in a matrix polymer records and erases as it forms transparent states and opaque states by heating and cooling processes.

To manufacture such reversible thermal recording materials obtained by dispersing organic crystal particles in a matrix polymer, the method of applying a paint, prepared by dissolving a matrix polymer and organic crystal particles in an organic solvent, on a substrate and forming particles by a drying process has been widely employed because of the high contrast of transparent/opaque phase thereby obtained.

In particular, for dissolving both a matrix polymer and organic crystal particles and forming a recording layer capable of giving recording characteristics of high contrast, the choice of organic solvents is extremely limited, and tetrahydrofuran has been widely employed as the solvent for these purposes.

In the reversible thermal recording medium known previously in this field, generally, when the film thickness of the reversible thermal recording layer is thin, sufficient turbidity in the opaque state is not obtained, and the visibility (contrast) is inferior. To solve these problems, the film thickness of the reversible thermal recording layer must be increased; and as the film thickness increases, it is necessary to transmit heat also throughout the film's thickness, thereby requiring a large heat source.

In addition, the increases in the film thickness result in slowing the recording speed, and also require a control in heating to provide a uniform temperature throughout the thickness of the recording layer.

Besides, in a case that a reversible thermal recording material is manufactured by applying a paint prepared by dissolving a matrix polymer and organic crystal particles in tetrahydrofuran, a continuous application by an ordinary coater is difficult, and a large-scale exhaust system is needed. This is because the volatility of tetrahydrofuran is high, resulting in poor paint stability and the spread of a strong smell.

Accordingly, a search has been made for a paint using general-purpose organic solvents which have low volatility and little smell or for a water-based paint. A paint capable of completely dissolving a matrix polymer or organic crystal particles by using such general-purpose organic solvents or water has been hardly discovered, and a reversible thermal recording material of high contrast could not be obtained from such paint.

Thus, in the paint using general-purpose organic solvents or water, a matrix polymer or organic crystal particles are contained in an amount greater than its solubility, and a part of the matrix polymer or organic crystal particles is dispersed in a granular form. In forming a reversible thermal recording layer from such paint, the organic crystal particles are aggregated in the reversible thermal recording layer, and the level of dispersion of the organic crystal particles tends to be poor.

For example, in forming a reversible thermal recording layer from a water-based emulsion paint, the film forming process (a to c) in FIG. 8 takes place. More specifically, as water evaporates from the state of FIG. 8*a* in which a lot of water is contained in the coating layer, the matrix polymer is filled up with emulsion particles 7 (FIG. 8*b*). At this time, organic crystal particles 3 aggregate, and by directly heating the coating layer above the minimum temperature required for forming a continuous film (minimum film-forming temperature), a continuous film is formed as emulsion particles 7 fuse with each other. As a result, a reversible thermal recording layer in which organic crystal particles are poorly dispersed is formed.

When the organic crystal particles are poorly dispersed in the reversible thermal recording layer, the interface area of the organic crystal particles and matrix polymer decreases. The rate of organic crystal particles contributing to the opaque state is also lowered, thus lowering the transparent/opaque contrast and visibility.

SUMMARY OF THE INVENTION

It is hence a first objective of the invention to provide a reversible thermal recording medium having excellent contrast. A second objective is to provide a method for manufacturing a reversible thermal recording medium excellent in contrast from a paint, in which a matrix polymer and organic crystal particles are contained and at least one of the matrix polymer and organic crystal particles is dispersed in a granular form. A third objective is to provide an apparatus for manufacturing a reversible thermal recording medium excellent in contrast from the paint mentioned above.

The first objective of the invention is achieved by the reversible thermal recording medium, having a reversible thermal recording layer on a substrate. The reversible thermal recording layer is formed by applying a paint, in which organic crystal particles and matrix polymer are contained and the organic crystal particles are dispersed, to the substrate. Therefore, the thermal recording medium can reversibly show transparent states and opaque states by cooling after two modes of heating.

FIG. 2 shows the recording characteristics of a reversible thermal heating medium used in the invention. After heating above temperature $T_3$ and then cooling down to room temperature under $T_0$, the organic crystal particles in the matrix polymer are in a polycrystalline state, and the reversible thermal recording medium is in an opaque state due to the scattering incident light among organic crystal particles of the polycrystal. After heating from temperature $T_1$ to $T_2$ and then cooling down to room temperature below $T_0$, the grain boundary of the polycrystalline organic crystal particles is dissolved, and the reversible thermal recording medium becomes transparent.

It is preferable that the reversible thermal recording layer comprises pores formed in the matrix polymer.

It is also preferable that the mean pore size of the pores of the reversible thermal recording layer is from 0.1 to 10 μm.

It is further preferable that the porosity of the reversible thermal recording layer is from 5 to 50 vol. %.

It is preferable that the reversible thermal recording layer comprises gaps formed in the interfaces of the organic crystal particles and the matrix polymer.

It is also preferable that the mean particle size of the organic crystal particles is 3 μm or less.

It is further preferable that the mean width of the gaps formed in the reversible thermal recording layer is 1 μm or less.

A method for manufacturing the reversible thermal recording medium having a porous reversible thermal recording layer on a substrate, comprises a coating step of applying a paint in which a matrix polymer, organic crystal particles and pore forming particles are contained and at least one of the matrix polymer and organic crystal particles is dispersed in a granular form on the substrate to form a coating layer; a solvent contact step of eluting the pore forming particles by contacting the coating layer with a solvent in which the pore forming particles are soluble; and a drying step.

It is preferable that the solvent contact step is effected by immersing the coating layer in the solvent.

It is also preferable that the pore forming particles are soluble in water or alcohol.

It is preferable that the coating layer is a layer made from a water-based emulsion paint containing an emulsifier. More preferably the pore forming particles are the emulsifier.

It is also preferable that the coating layer contains an organic solvent of high boiling point having a compatibility for the solvent. More preferably the organic solvent of high boiling point remains in the coating layer in the solvent contact step.

Another method for manufacturing the reversible thermal recording medium having a porous reversible thermal recording layer on a substrate, comprises a coating step of applying a paint in which a matrix polymer and organic crystal particles are contained and at least one of the matrix polymer and organic crystal particles is dispersed in a granular form on a substrate to form a coating layer; a solvent contact step of contacting the coating layer with a solvent in which the matrix polymer and organic crystal particles are soluble; and a drying step.

It is preferable that the organic crystal particles are crystalized after the solidification of the matrix polymer when the organic crystal particles have higher solubility in the solvent than the matrix polymer, thereby forming gaps during the drying step due to contraction of the organic crystal particles.

It is also preferable that the drying step is carried out at a temperature higher than the melting point of the organic crystal particles, and that the organic crystal particles are in a supercooled state below the glass-transition temperature of the matrix polymer after the drying step, thus crystalizing the organic crystal particles in a vitrified matrix polymer and forming gaps due to contraction of the organic crystal particles.

It is preferable that the solvent contact step is effected by immersing the coating layer in the solvent.

It is also preferable that the solvent contact step is effected by exposing the coating layer to the vapor of the solvent.

It is further preferable that the paint contains an organic solvent of high boiling point, having a compatibility for the solvent and dissolving both matrix polymer and organic crystal particles. More preferably the organic solvent of high boiling point remains in the coating layer in the solvent contact step.

It is preferable that the organic solvent of high boiling point has a boiling point in a range of 120° to 180° C.

It is preferable that the paint is a water-based emulsion paint containing an emulsifier.

It is preferable that a provisional drying step for drying the coating layer at a temperature below the minimum film-forming temperature of the paint is carried out between the coating step and the solvent contact step. More preferably the paint is a water-based emulsion paint containing an emulsifier.

It is also preferable that the paint comprises the matrix polymer which is a resin mainly composed of repeating units of vinyl chloride units or a resin mainly composed of polyester, and organic crystal particles with higher aliphatic compounds having hydrogen bonds.

It is further preferable that the solvent contact step is effected by causing the coating layer to come into contact with the solvent containing at least one type of solvent selected from the group consisiting of acetone, methyl acetate, ethyl acetate, tetrahydrofuran, and methylene chloride.

It is preferable that the paint comprises glycol monoalkyl ether or dimethyl formamide as the organic solvent of high boiling solvent.

It is also preferable that the glycol monoalkyl ether is selected from the group consisting of ethylene glycol monomethyl ether, ethylene glycol monoethyl ether, ethylene glycol monopropyl ether, and ethylene glycol monobutyl ether.

It is further preferable that the paint is a water-based emulsion paint including an alcohol. More preferably the alcohol is selected from the group consisting of propanol, butanol, and isoamyl alcohol.

The second objective is achieved by either of the two methods mentioned above.

The third objective is achieved with a manufacturing apparatus for a reversible thermal recording medium, which is characterized by comprising solvent contact means for exposing the coating layer to the vapor of a solvent while placing a cloth sheet, impregnated with the solvent in which the matrix polymer and organic crystal particles are soluble, oppositely with a gap against the coating layer. In this case, the coating layer is formed on a substrate by applying a paint in which the matrix polymer and organic crystal particles are contained and at least one of the matrix polymer and organic crystal particles is dispersed in a granular form.

It is preferable that the cloth sheet is a cloth foil resistant to the solvent selected from the group consisting of woven cloth, nonwoven cloth, and air permeable net.

It is also preferable that the solvent vapor contact means comprises a band-shaped cloth sheet in roll form, a rotary roll, a solvent feed part, a solvent evaporating part, and a cover box; the band-shaped cloth sheet is impregnated with the solvent in the solvent feed part containing the solvent; and the solvent vapor contact means rotates and moves the band-shaped cloth sheet impregnated with the solvent to the evaporating part by the rotary roll, thereby placing the coating layer and the band-shaped cloth sheet face to face across a gap in the evaporating part and exposing the coating layer to vapor of the solvent.

It is further preferable that the solvent feed part and the solvent evaporating part are located in the cover box which prevents outflow of the vapor of the solvent, and that the solvent feed part is used as a means for immersing the band-shaped cloth sheet in a container filled with the solvent or as a means for spraying the solvent onto the band-shaped cloth sheet.

It is preferable that the manufacturing apparatus further comprises means for controlling the temperature of the solvent feed part and the solvent evaporating part inside the cover box, and that the means for controlling comprise at least one hot plate. More preferably the hot plate is located facing at least one side surface of the cloth sheet and the substrate formed with the coating layer.

The principle of recording and erasing of the reversible thermal recording medium depends on the changes in a light scattering state due to the changes in the crystal state of organic crystal particles. The transparency and opacity of a recording layer in this field has been hitherto said to depend on the crystallinity of organic crystal particles and the mutual action of the organic crystal particles and the matrix polymer. The contrast has been said to be dependent on the film thickness of the recording layer, the mean particle size of the organic crystal particles, the level of dispersion of the organic crystal particles in the matrix polymer, the difference in light scattering of organic crystal particles between the transparent state and the opaque state, and the transparency of the matrix polymer, or the like.

The visibility enhancing means of the invention, however, have been made by forming a part possessing a different refractive index in the recording layer and by scattering more effectively the light from the organic crystal particles in a opaque state. More specifically, in the invention, a part having a refractive index difference is formed by a porous reversible thermal recording layer. In the invention, the porous reversible thermal recording layer is available in the following two representative compositions.

(1) A reversible thermal recording layer in which pores are formed in the matrix polymer.

(2) A reversible thermal recording layer in which the gaps are formed in the interfaces between the organic crystal particles and matrix polymer.

First, in the reversible thermal recording layer of type (1), there is a large difference in refractive index between the pores and the matrix polymer, and the scattered light obtained by shining light onto the organic crystal particles in the opaque state is more randomly reflected on the interface of the pores and matrix polymer, thereby emphasizing the scattering and enhancing the turbidity of the opaque state. On the other hand, in the transparent state, by nature, the transparency of the organic crystal particles and matrix polymer is high. In a case that light is shone onto the organic crystal particles in their transparent state, scattering of light hardly takes place although refraction occurs depending on the refractive index difference between the organic crystal particles and the pores in the monocrystalline state. The refraction is not random but only in one specific direction. Hence there is almost no effect on the transparency. Accordingly, the contrast between the opaque state and the transparent state is enhanced, thus producing the reversible thermal recording medium excellent in visibility of this invention.

And since the reversible thermal recording layer of type (2) has a large difference in refractive index between the gaps and the organic crystal particles, the scattering in the opaque state is emphasized as in the case of type (1). As a result, the turbidity is improved, and the contrast between the opaque state and the transparent state is enhanced because there is almost no effect on transparency in the transparent state. In this composition, however, since the portion responsible for refractive index difference is in contact with the organic crystal particles which are scattering parts, the scattered light in the organic crystal particles in the opaque state is reflected randomly on the interface against the gaps at a high degree of probability. In this sense, the composition of type (2) is more effective than the composition of type (1).

The first manufacturing method of the invention forms the reversible thermal recording layer of type (1), and a reversible thermal recording medium excellent in visibility is obtained.

The second manufacturing method of the invention forms the gaps shown in type (2) when the organic solvent used in the solvent contact step is evaporated from the coating layer. This is because the solubility of the matrix polymer and organic crystal particles in the solvent, or the precipitation speed of the matrix polymer and organic crystal particles from the solvent is different. The gaps are formed due to the contraction of the organic crystal particles, which are crystalized after the solidification of the matrix polymer. Alternatively, when the matrix polymer is solidified after the crystalization of the organic crystal particles, the gaps are formed due to the contraction of the solidified matrix polymer. At the same time, re-arrangement or re-precipitation of the matrix polymer and organic crystal particles originates from a swollen or dissolved state, and the organic crystal particles are dispersed in the matrix polymer as fine particles, thereby forming the reversible thermal recording layer; the level of dispersion of the organic crystal particles is significantly improved. Thus, by forming the reversible thermal recording layer with an improved dispersed state of organic crystal particles, a reversible thermal recording medium excellent in visibility is obtained.

The vapor of the solvent at high concentration can be uniformly applied over the entire surface of the coating layer in a short time by the manufacturing apparatus of the invention mentioned above. In particular, since vapor treatment is conducted by using the vapor from the cloth sheet impregnated with the solvent, the solvent can be uniformly applied on the surface of the coating layer surface without generating the dew condensation from the vapor of the volatile solvent, as compared with the treatment of using the vapor directly from the liquid surface of the solvent.

DETAILED DESCRIPTION OF THE INVENTION

1.1 Reversible Thermal Recording Layer

Figure 1:
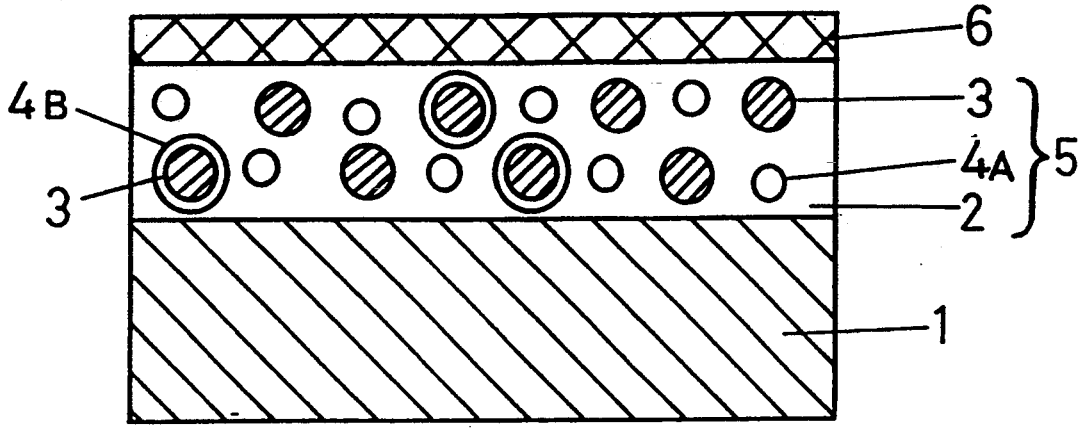
FIG. 1 is a sectional view showing an embodiment of a reversible thermal recording medium of the invention.

A representative example of a reversible thermal recording medium of the invention is shown in FIG. 1. A reversible thermal recording layer 5 composed of a matrix polymer 2, organic crystal particles 3, pores 4A formed in the matrix polymer, and gaps 4B formed in the interfaces between the organic crystal particles 3 and matrix polymer 2, and a protective layer 6 are sequentially layered on a substrate 1. Incidentally, the effect of the invention is expressed even if either of the pores 4A or the gaps 4B are formed.

The type and shape of pores 4A and gaps 4B vary significantly depending on the manufacturing method. However, in this invention, the effect of the invention appears regardless of the type or shape of the pores 4A or gaps 4B since the presence of the interface of the pores 4A or gaps 4B and the reversible thermal recording material (organic crystal particles 3 and matrix polymer 2) contributes to the enhancement of turbidity. In particular, gaps 4B are preferred to be formed so as to surround organic crystal particles 3 rather than to be formed in part of the interface of the matrix polymer and organic crystal particles. This is because the area of the interfaces between gaps 4B and organic crystal particles 3 is greater. The pores 4A or gaps 4B may be present independently or in conjunction with each other.

The mean size of pores 4A is preferably about 0.1 to 10 μm, but the smaller mean size is more effective because the area of interface to the reversible thermal recording material per volume is greater. If the total volume of the pores occupying reversible thermal recording layer 5 is too small, the effect of the pores hardly appears; if it is too large, the volume of the reversible thermal recording material comprised of the matrix polymer and organic crystal particles itself occupying reversible thermal recording layer 5 is lowered, thus reducing the turbidity of the opaque state. Hence the porosity of the reversible thermal recording layer is appropriate in a range of about 5 to 50 vol. %.

In particular, when the mean width of gaps 4B becomes large, the mutual action of the matrix polymer and organic crystal particles becomes small. As a result, the visibility of recording becomes poor. Hence the mean width of the gaps is preferred to be 1 μm or less. As mentioned above, it is preferred that gaps 4B be formed so as to surround organic crystal particles 3 because the interface of gaps 4B and organic crystal particles 3 becomes greater as a result. However, if organic crystal particles with 3 μm or less mean particle size are dispersed, it is effective as the area of the interface with gaps 4B per unit volume of organic crystal particles increases.

The distribution of pores 4A or gaps 4B is desired to be macroscopically uniform in reversible thermal recording layer 5, but they may be also distributed uniformly near the surface of reversible thermal recording layer 5. If the distribution of pores 4A or gaps 4B is not uniform, the turbidity displayed in the opaque state may be uneven.

As the method of forming reversible thermal recording layer 5, general plastic foam manufacturing methods such as solvent decomposition methods and solvent dissipation methods may be applied. In particular, by employing the manufacturing method for the reversible thermal recording medium of the invention explained below, reversible thermal recording layer 5 may be easily and effectively obtained.

1.2 Material Composition of the Reversible Thermal Recording Medium

1.2.1 Matrix Polymer

Matrix polymer 2 composing reversible thermal recording layer 5 of the invention must be able to disperse and maintain organic crystal particles 3 uniformly in a granular form, and must possess a high transparency in the transparent state. Accordingly, superior film-forming performance, excellent mechanical properties, and an optically transparent nature are preferred.

Examples of such resins include polyvinyl chloride, polyvinyl acetate, polyvinylidene chloride, vinyl chloride-vinyl acetate copolymer resin, vinyl chloride-vinyl acetate-vinyl alcohol copolymer resin, vinyl chloride-vinyl acetate-maleic acid copolymer resin, vinyl chloride-acrylate copolymer resin, vinyl chloride-vinylidene chloride copolymer resin, vinylidene chloride-acrylonitrile copolymer resin, other resins having vinyl chloride as a repeating unit, polyester resin, polyamide resin, polyacrylic resin, polymethacrylic resin, acrylmethacryl copolymer resin, and butyral resin, which may be used either alone or in combination of two or more kinds.

Above all, resins having a vinyl chloride unit as the principal repeating unit and polyester resins, such as vinyl chloride-vinyl acetate copolymer resin, vinyl chloride-partially saponified vinyl acetate copolymer resin, vinyl chloride-vinyl acetate-vinylamine copolymer resin, vinyl chloride-vinyl acetate-vinyl methanol amine copolymer resin, vinyl chloride-vinyl acetate-vinyl ethanol amine copolymer resin, vinyl chloride-vinyl acetate-maleic acid copolymer resin, vinyl chloride-vinyl acetate-acrylic acid ester copolymer resin, and vinyl chloride-vinyl acetate-acrylic acid ester-acrylic acid copolymer resin, are suited to the invention because of their preferable mutual actions with organic crystal particles.

1.2.2 Organic Crystal Particles

Figure 2:
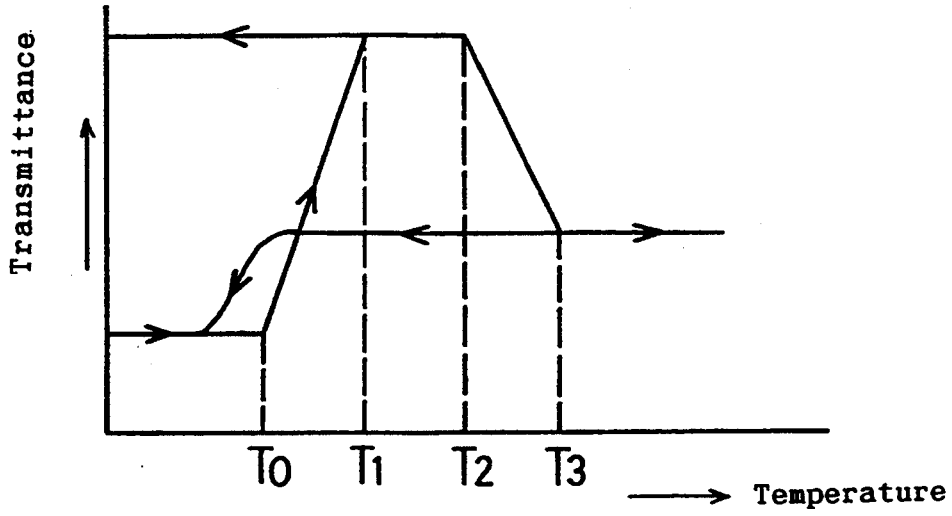
FIG. 2 is a diagram showing the recording characteristics of the reversible thermal recording medium of the invention.

As organic crystal particles 3 for reversible thermal recording layer 5 of the invention, compounds which show temperature characteristics as shown in FIG. 2 by being dispersed in matrix polymer 2 are used. The transparent temperature range ($T_1$ to $T_2$) and opaque temperature range ($T_2$ to $T_3$) may be selected.

The melting point of the compound of organic crystal particles 3 is preferred to be in the range of 30° to 200°

C., and considering the allowance of reversible thermal recording, it is desired to be in a range of 50° to 150° C.

Practical examples of molecules for the organic crystal particles include hydrocarbon molecules such as alkane, alkene, alkyne, cycloalkane, cycloalkene and cycloalkyne, alkyl ammonium salt, thioalcohol, thiocarboxylic acid or their esters, amide, or ammonium salt, ester carboxylate of thioalcohol, and halogen compounds of these compounds. The molecular weight may be selected to control the range of melting points and vapor points, and they can be used either alone or in combination of more than one kind.

Above all, it is preferred that organic crystal particles 3 comprise a higher aliphatic compound containing hydrogen bonds. This is because the visibility is enhanced by the mutual action between the hydrogen bonds and the matrix polymer. That is, for example, among the compounds containing —O— group, —OH group, —COOH group, —CONH— group, —NH— group, —$NH_2$ group, etc., higher aliphatic alcohol, higher fatty acid, higher aliphatic dicarboxylic acid, oxycarboxylic acid, and higher aliphatic amide may be used. These compounds may be used either alone or in combinations of more than one type, and the number of carbon atoms in these compounds is desired to be 10 to 60 in consideration of the melting point, preferably 10 to 38, and more preferably 10 to 30.

The composition ratio of matrix polymer 2 to the compound of organic crystal particles 3 is desired to be 0.5:1 to 20:1 by weight. If the composition ratio of matrix polymer 2 to the compound is lower than 0.5:1, the content of organic crystal particles 3 increases. As a result, uniform coating of reversible thermal recording layer 5 becomes difficult. On the contrary, if the composition ratio of matrix polymer 2 to the compound exceeds 20:1, the content of organic crystal particles 3 decreases. Accordingly, opacity becomes poor, and the visibility is lowered.

1.2.3 Substrate

Substrate 1 of the invention is selected in consideration of strength, rigidity or the like. Nylon, cellulose acetate resin, polystyrene, polyethylene, polypropylene, polyester, polyimide, polycarbonate, polyvinyl chloride, and other plastics may be used either alone or in combination. As substrate 1, polyester or polyvinyl chloride are useful. To maintain the shape as the reversible thermal recording medium, a sufficient thickness is required for substrate 1. The thickness of substrate 1 is generally about 0.05 to 5 mm. Moreover, an information recording layer other than a thermal recording layer, such as a magnetic recording layer, may also be formed on substrate 1.

1.2.4 Protective Layer

Protective layer 6 of the invention is effective to prevent the reduction of recording characteristics due to the entry of impurities from the surrounding atmosphere into reversible thermal recording layer 5, or to improve the mechanical strength of reversible thermal recording layer 5. As the resin component used for protective layer 6, thermosetting resins such as acrylic resin, epoxy resin, and unsaturated polyester resin are preferred because they can provide a high hard coating effect. In case of using an acrylic ultraviolet radiation setting resin, the resin can be easily hardened by being irradiated with ultraviolet rays after the application; the resin also has excellent transparency.

1.3 Outline of Manufacturing Method of the Invention

The manufacturing method of the reversible thermal recording medium of the invention is realized in the following two methods.

(M-1) A manufacturing method, comprising a coating step of applying a paint in which matrix polymer 2, organic crystal particles 3 and pore forming particles are contained and at least one of matrix polymer 2 and organic crystal particles 3 is dispersed in a granular form on a substrate to form a coating layer; a solvent contact step of eluting the pore forming particles by contacting the coating layer with a solvent capable of dissolving the pore forming particles; and a drying step.

(M-2) A manufacturing method, comprising a coating step of applying a paint in which matrix polymer 2 and organic crystal particles 3 are contained and at least one of matrix polymer 2 and organic crystal particles 3 is dispersed in a granular form on a substrate to form a coating layer; a solvent contact step of contacting the coating layer with a solvent capable of dissolving matrix polymer 2 and organic crystal particles 3; and a drying step.

For instance, a conceptual diagram of the manufacturing method of (M-1) is shown in FIG. 3 while a conceptual diagram of the manufacturing method of (M-2) is shown in FIG. 4. A water-based emulsion paint in which matrix polymer 2 or organic cystal particles 3 are contained in a granular form is used for these methods.

Figure 3A:
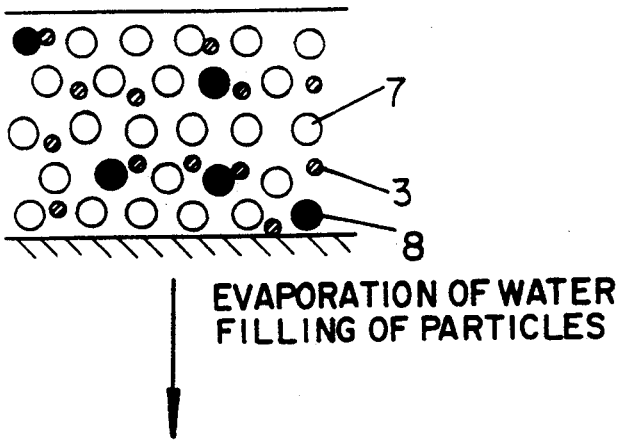
FIG. 3 is a conceptual diagram showing an embodiment of the manufacturing method of a reversible thermal recording medium of the invention.
Figure 3B:
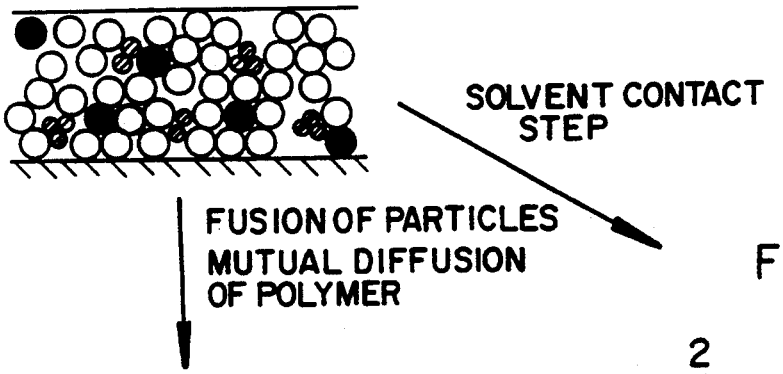
Figure 3D:
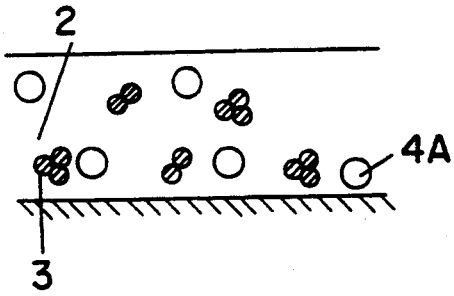
Figure 3C:
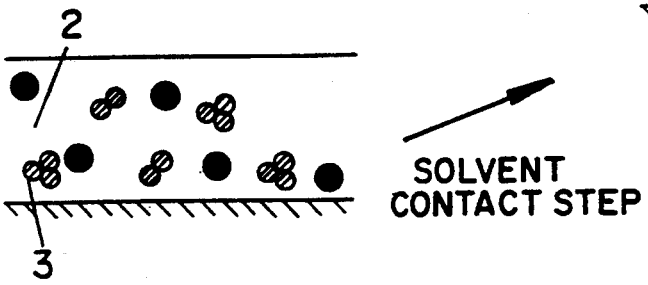

As water evaporates from the state of FIG. 3*a* in which a lot of water is contained in the coating layer, matrix polymer 2 is filled up with emulsion particles 7 (FIG. 3*b*). FIG. 3*c* shows a continuous film formed by directly heating the coating layer above the minimum temperature required for forming the continuous film. Through a solvent contact step after the step of FIG. 3*b* or FIG. 3*c*, pore forming particles 8 are eluted, and pores 4A are formed in reversible thermal recording layer 5 (FIG. 3*d*), thus improving the visibility of reversible thermal recording layer 5.

Figures 4A, 4B, 4C, 4D:
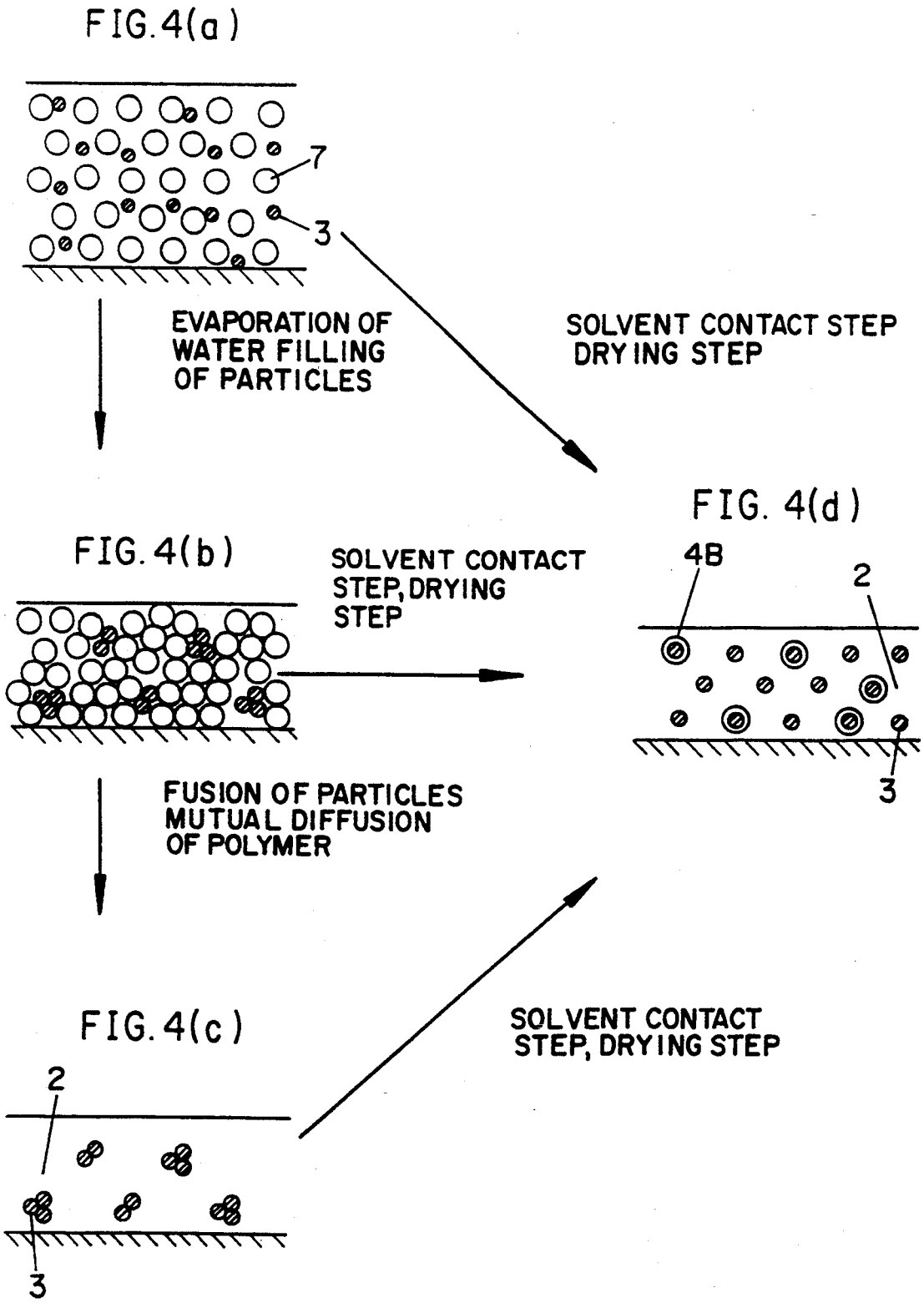
FIG. 4 is a conceptual diagram showing another embodiment of the manufacturing method of a reversible thermal recording medium of the invention.

As water evaporates from the state of FIG. 4*a* in which a lot of water is contained in the coating layer, matrix polymer 2 is filled up with emulsion particles 7 (FIG. 4*b*). FIG. 4*c* shows a continuous film formed by directly heating the coating layer above the minimum temperature required for forming the continuous film. Through a solvent contact step and a drying step after the state of FIG. 4*a*, FIG. 4*b* or FIG. 4*c*, gaps 4B are formed in reversible thermal recording layer 5 as the solvent evaporates from the coating layer (FIG. 4*d*). When organic crystal particles 3 are crystalized after the solidification of matrix polymer 2, gaps 4 B are formed after the drying step. The rearrangement and redeposition of matrix polymer 2 and organic crystal particles 3, at the same time, is generated, and organic crystal particles 3 are dispersed in a granular form in matrix polymer 2. Therefore, reversible thermal recording layer 5 containing dispersed organic crystal particles 3 and having excellent visibility is formed by the manufacturing method of (M-2).

In addition, reversible thermal recording layer 5, containing dispersed organic crystal particules 3 and having pores 4A and gaps 4B, can also be formed by carrying out the solvent contact methods of both (M-1) and (M-2) and using a solvent in which matrix polymer 2, organic crystal particles 3 and pore forming particles 8 are soluble.

The solvent used in the invention contains the solvent possessing the above properties either by itself or together with another liquid. The solvent may be either a uniform solution or a dispersed solution, but in case of a dispersed solution, a colloidal solution is preferred from the viewpoint of dispersion stability.

1.3.1 Manufacturing method of (M-1)

In the manufacturing method of (M-1), as the method of contacting the coating layer with the solvent, the method of immersing the coating layer in the solvent is effective.

It is effective to set the temperature of the solvent at a proper level in the solvent contact step, thereby obtaining pores. This is because the hardness of the coating layer varies with the temperature of the solvent, and the immersion speed of the solvent into the coating layer varies. Therefore, the time of the solvent contact step can be controlled. Simultaneously applying ultrasonic wave to the coating layer in the solvent contact step is effective for obtaining pores. However, if the ultrasonic wave is too intense, the coating layer can be easily peeled off from substrate 1.

The pore forming particles are not particularly defined as far as they disperse in a granular form in the coating layer after the formation of the coating layer, and elute into the solvent in the solvent contact step. In particular, when the pore forming particles are soluble in water or alcohol, matrix polymer 2 and organic crystal particles 3 cannot be dissolved in these solvents. Therefore, in case of using these solvents as the solvent, the coating layer does not elute in the solvent contact step, thereby selectively eluting only the pore forming particles and making the solvent contact step easier.

For example, in general inorganic salts such as sodium chloride, potassium chloride, and sodium carbonate, and water-soluble high molecules such as polyvinyl alcohol and polyethylene glycol are applicable as pore forming particles soluble in water.

In particular, when a water-based emulsion paint is used, the emulsifier used for emulsifying matrix polymer 2 or organic crystal particles 3 may be directly used as the pore forming particles. That is, when the coating layer is formed from a water-based emulsion paint containing matrix polymer 2, organic crystal particles 3 and emulsifier, the hydrophobic emulsifier aggregates easily into the hydrophobic coating layer. Then, only the aggregated emulsifier elutes from the coating layer by contacting the coating layer with water. As a result, multiple pores 4A are formed in reversible thermal recording layer 5.

1.3.2 Manufacturing method of (M-2)

In the manufacturing method of (M-2), as the method of contacting the coating layer with the solvent, a method of immersing the coating layer or a method of contacting the coating layer with the vapor of the solvent is effective because the solvent contact step may be done relatively easily.

In the method of immersing the coating layer in the solvent, since the solvent dissolves matrix polymer 2 and organic crystal particles 3, the solvent permeates into the coating layer very quickly. Therefore, by only immersing the coating layer in the solvent in a short time, the effect of this step is expressed without eluting the coating layer. However, if the contact time is long, a part of reversible thermal recording layer 5 may be dissolved. By adding water or alcohol, which can not dissolve matrix polymer 2 and organic crystal particles 3, abrupt elution of the coating layer may be suppressed. Besides, the same as in (M-1), performing the solvent contact step by setting the temperature of the solvent at a proper level is effective for obtaining gaps in the thermal recording layer of the invention.

On the other hand, in the method of contacting the coating layer with the vapor of the solvent, only the vapor contacts the coating layer, and the coated surface including matrix polymer 2 and organic crystal particles 3 is not disturbed, thereby providing clean reversible thermal recording layer 5. The solvent contact step is directed easily by leaving the coating layer in a covered box filled with the vapor of the solvent, and the time required for the solvent contact step can be adjusted by regulating the temperature in the box. In particular, by employing the manufacturing apparatus of the reversible thermal recording medium of the invention described below, the solvent contact step can be carried out more effectively. At the same time, the method of spraying the solvent onto the coating layer is also effective.

In the manufacturing method of (M-2), as the solvent used in the solvent contact step, any organic solvent may be used as long as matrix polymer 2 and organic crystal particles 3 are soluble in the solvent. In addition, it is more effective if matrix polymer 2 or organic crystal particles 3 are soluble in the solvent. In particular, in the method of contacting the coating layer with the vapor of the solvent in the solvent contact step, it is preferred that the solvent be volatile. Since the solubility of matrix polymer 2 and organic crystal particles 3 in the solvent and the precipitation speed of organic crystal particles 3 in a drying step differ with the kind of the solvent, the particle size and dispersion state of organic crystal particles 3 in matrix polymer 2 depend on the type of solvent. The visibility of reversible thermal recording layer 5, in addition, tends to be influenced by the type of solvent used for manufacturing the paint, in case of forming the layer from the paint.

In particular, in the case that matrix polymer 2 of a coating layer is a copolymer mainly comprising vinyl chloride units or a polyester resin, and that organic crystal particles 3 of the layer are made of higher aliphatic compound having hydrogen bonds, the solvent is preferred to contain at least one organic solvent selected from the group consisting of acetone, methyl acetate, ethyl acetate, tetrahydrofuran, and methylene chloride. These organic solvents are effective because matrix polymer 2 or organic crystal particles 3 are soluble in these solvents. Among the organic solvents, tetrahydrofuran is especially a useful solvent since both matrix polymer 2 and organic crystal particles 3 are dissolved very well in the solvent. Due to its high volatility, tetrahydrofuran is also effective for contacting the coating layer with its vapor in the solvent contact step.

1.3.3 Solvent

The manufacturing methods, (M-1) and (M-2), of the invention involve the solvent contact step, and the time required for the solvent contact step can be controlled by the permeation speed of the solvent into the coating layer.

If the paint used in the invention contains an organic solvent of high boiling point soluble in the solvent used in the solvent contact step, the organic solvent of high boiling point left in the coating layer is replaced by the solvent in the solvent contact step; the solvent quickly permeates into the film so that the time of solvent contact step can be shortened.

As the solvent, any solvent having the above properties may be used. However, in case of using a water-based emulsion paint, the solvent must have an affinity for water. As a solvent to be added to the water-based emulsion paint, alcohol, ketone, ester, alkyl halide, and amide are preferred because of their affinity for water. In particular, when the solvent added to the water-based emulsion paint is alcohol, any one of propanol, butanol and isoamyl alcohol is preferred because of their affinity for both water and organic crystal particles 3, so that it is more effective to stabilize organic crystal particles 3 in water.

1.3.4 Noncontinuous Film

Under the condition of a noncontinuous film not binding the emulsion particles of matrix polymer after a coating step with a water-based emulsion paint and a provisional drying step below the minimum film-forming temperature, multiple gaps are generated in the coating layer, and the solvent permeates into the coating layer very quickly by capillary attraction. The time of the solvent contact step can thus be extremely shortened, which is very preferable.

Figure 5A:
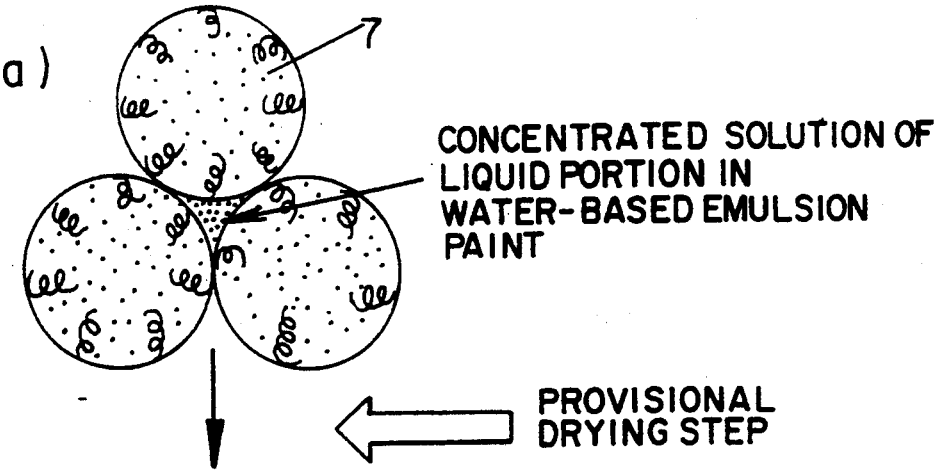
FIG. 5 is a conceptual diagram showing a film forming process from water-based emulsion paint.
Figure 5B:
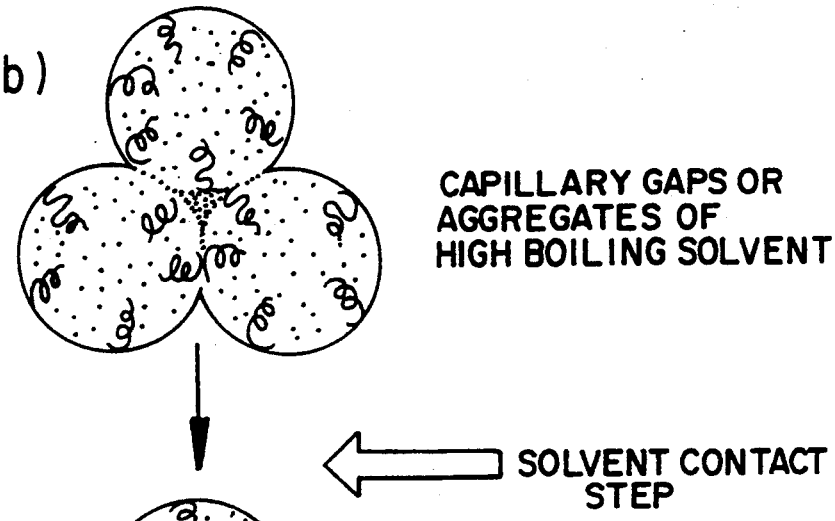
Figure 5C:
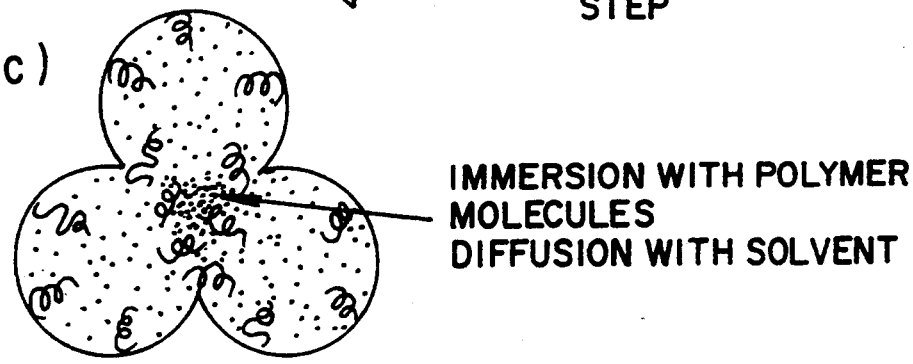

That is, by directing the provisional drying step after the state (a) of FIG. 5, the liquid portion of the water-based emulsion paint, especially the component which is hard to evaporate, is left and concentrated in the coating layer. As a result, the emulsion particles are solidified as shown in (b), and capillary gaps or aggregates containing residual solvent are formed among the emulsion particles.

When such solidified emulsion particles are subjected to the solvent contact step, liquid or vapor is sucked into the capillary gaps of (b) or in the region containing residual solvent. Therefore, mutual diffusion occurs between the polymer molecules and permeating molecules in this area, thus greatly shortening the time required for the solvent contact step.

1.3.5 Coating Step

In the coating step of the invention, the coating means is not particularly specified and may include gravure coating, roll coating, air knife process, and others. By drying the coating layer in the provisional drying step right after the paint application, the handling of the coating layer becomes easy, and the next solvent contact step may be made easier.

1.3.6 Drying Step

In the drying step of the invention, by drying the coating layer after the solvent contact step, the organic solvent of high boiling point and the solvent left in the layer are evaporated, and reversible thermal recording layer 5 is formed. The drying temperature is set in consideration of the boiling point of the organic solvent of high boiling point or the solvent. Especially, in the case of the manufacturing method of (M-2), when the drying step is carried out at a temperature higher than the melting point of organic crystal particles 3, and organic crystal particles 3 are in a supercooled state below the glass-transition temperature of the matrix polymer after the drying step, the gaps are formed effectively due to contraction of organic crystal particles 3 crystalizing in a vitrified matrix polymer 2. The coating layer is usually dried by blowing hot air on the layer or contacting substrate 1 with a hot plate.

1.4 Fabrication of paint

The paint used in the manufacturing method of the reversible thermal recording medium of the invention is a paint, in which matrix polymer 2 and organic crystal particles 3 are contained and at least one of matrix polymer 2 and organic crystal particles 3 is dispersed in a granular form.

As the paint, a paint using a general-purpose organic solvent of low volatility and odor or a water-based emulsion paint is preferred in consideration of a long-term application and the prevention of environmental pollution.

Especially in the case that matrix polymer 2 is a resin mainly composed of repeating units of vinyl chloride units or a resin mainly composed of polyester, and that organic crystal particles 3 include higher aliphatic compounds having hydrogen bonds, at least one organic solvent selected from the group consisting of alcohol, methyl ethyl ketone, toluene, and ethylene glycol ether is suited for the general-purpose paint of low volatility and odor. Usually, the solubility of the organic crystal particles in these organic solvents is not high. Therefore, in order to disperse the fine particles of organic crystal particles 3 in the paint, organic crystal particles 3 are mixed in an organic solvent in which matrix polymer 2 is dissolved or swollen, and the paint is then processed by a sand mill, ball mill, attriter, or another grinder.

On the other hand, in the fabrication of water-based emulsion paint, since matrix polymer 2 and organic crystal particles 3 are hydrophobic, it is hard to stabilize matrix polymer 2 and organic crystal particles 3 in the paint. However, the following two methods are effective to provide a stable paint without aggregating organic crystal particles 3 in the paint:

(P-1) Method of mixing and stirring a water-based emulsion dispersion of matrix polymer 2 and a water-based emulsion dispersion of organic crystal particles 3; and (P-2) Method of formulating the ground fine particles into a water-based emulsion paint after mixing, melting and cooling matrix polymer 2 and organic crystal particles 3.

In the method of (P-1), pulverized organic crystal particles 3 are stably and uniformly dispersed to prepare a water-based emulsion dispersion. The emulsion dispersion is then mixed and stirred with a water-based emulsion dispersion of matrix polymer, thereby providing a water-based emulsion paint. Both ingredients are water-based emulsions, and they can be dispersed well without particularly powerful mixing and stirring, and the organic crystal particles are dispersed homogeneously.

Besides, a water-based emulsion paint of excellent dispersion stability is prepared by treating a mixed solution of water-based emulsion dispersion of matrix polymer 2, organic crystal particles 3, emulsifier, water, and organic solvent in a grinding process by attriter, ball mill or the like, and pulverizing organic crystal particles 3.

In the method of (P-2), matrix polymer 2 and organic crystal particles 3 are mixed and melted above their respective melting temperatures to prepare fine particles preliminarily. As a result, the dispersion state of organic crystal particles 3 in polymer matrix 2 becomes excellent, and reversible thermal recording layer 5 thus fabricated shows recording characteristics of high visibility and high contrast.

For grinding, any ordinary grinding method may be employed, and when matrix polymer 2 is soft, it is easy to grind by setting the grinding temperature below the glass transition temperature of matrix polymer 2.

The stability and thixotropy of water-based emulsion paint vary perceptibly depending on the pH or type of emulsion, and these points must be sufficiently taken into consideration when mixing and preparing the water-based emulsion paint. Common emulsifiers include anionic, cationic, and nonionic compounds, and it is desirable to combine these emulsifiers properly.

A water-based emulsion dispersion of matrix polymer 2 is mainly prepared by emulsifying polymerization and solid polymer emulsifying methods.

As emulsifiers required for emulsifying polymerization or emulsification of solid polymer, ordinary surface active agents may be used. For example, soaps, alkyl benzene sulfonate, alkyl sulfate, and dialkyl sulfosuccinate are used. Or, by swelling a solid polymer in an organic solvent, and dispersing it in water, a water-based emulsion dispersion may be prepared. In this case, as the organic solvent, alcohol or ethylene glycol monoalkyl ether having an affinity for water may be used.

As the water-based emulsion dispersant for organic crystal particles 3, ordinary surface active agents mentioned above may be used. It is also possible to emulsify organic crystal particles 3 by adding an organic solvent possessing a relative affinity for water. As such organic solvent, for example, alcohol, ether, ketone, ester, halogenated alkane, and amide are suitable.

1.5 Manufacturing Apparatus of the Invention

The manufacturing apparatus for the reversible thermal recording medium of the invention is described below.

Figure 6:
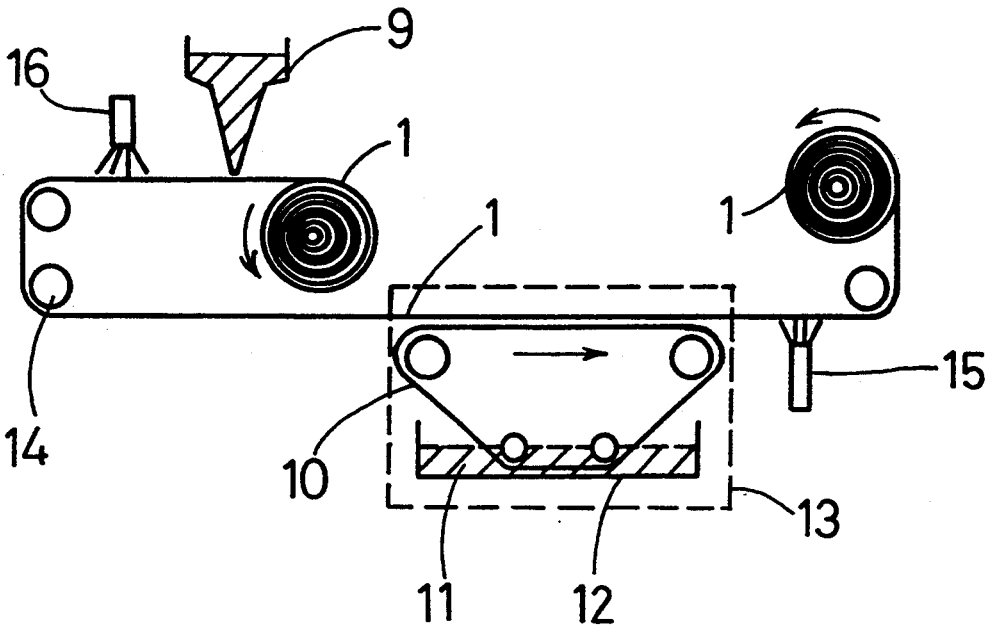
FIG. 6 is a diagram showing an embodiment of the manufacturing apparatus for the coating layer of the invention.

In the manufacturing methods of (M-1 and M-2), it is very effective to use a manufacturing apparatus which can conduct the solvent contact step by contacting the coating layer with the vapor of the solvent while keeping the coating layer spaced by a gap from the cloth sheet impregnated with the solvent. FIG. 6 shows a typical structural example of a manufacturing apparatus for the coating layer of the invention capable of performing continuous coating and vapor treatment.

On substrate 1 rolled in a roll, a paint 9, in which matrix polymer 2 and organic crystal particles 3 are contained and at least one of matrix polymer 2 and organic crystal particles 3 is dispersed in a granular form, is applied as a coating layer. A cloth sheet 10 impregnated with a solvent 11 is spaced by a gap from the coating layer across a gap, and the coating layer is exposed to the vapor of solvent 11.

Since the entire surface of the coating layer is uniformly and completely covered with the vapor of solvent 11 at high concentration, the solvent contact step may be conducted easily and efficiently.

The vapor treating means of the solvent is realized, for example as shown in FIG. 6, by band-shaped cloth sheet 10 in loop form, rotary roll 14, solvent feed part, solvent evaporation part, and cover box 13.

That is, in the cover box 13 for preventing outflow of the vapor of solvent 11, band-shaped cloth sheet 10 is rotated and moved by rotary roll 14, and solvent 11 is supplied in the solvent feed part and impregnated in band-shaped cloth sheet 10. Band-shaped cloth sheet 10 is set near the coating layer and spaced by a gap from it in the solvent evaporation part, thereby exposing it to the vapor of solvent 11.

Herein, since the vapor of solvent 11 has an affinity for the coating layer, it permeates into the coating layer.

Afterwards, solvent 11 is evaporated in drying step 15. The vapor of solvent 11 generated at this time is recovered by an exhaust device with a trap.

In this apparatus, the organic solvent used in the solvent contact step is isolated in cover box 13 in the solvent contact step, and the solvent leaks outside only in the drying step, so that solvent odor does not diffuse widely.

Figure 7:
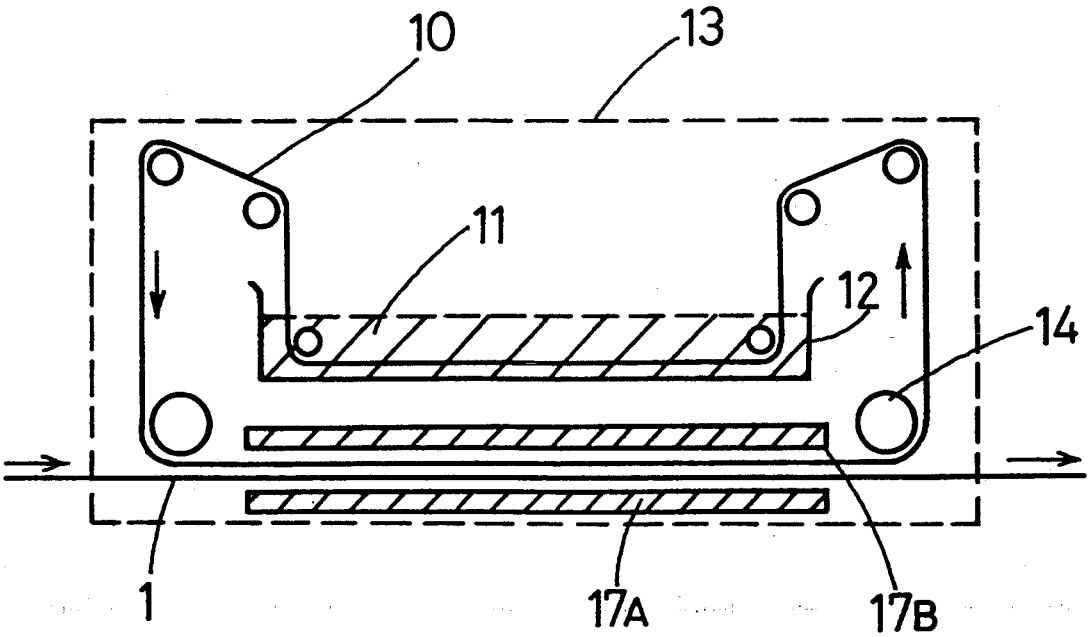
FIG. 7 is a diagram showing another embodiment of the manufacturing apparatus for the coating layer of the invention.
Figure 8A:
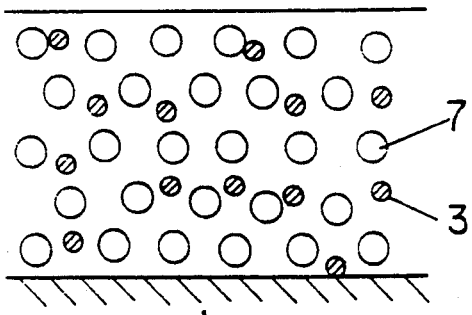
FIG. 8(a) PRIOR ART
FIG. 8 is a diagram showing a film forming process from water-based emulsion paint of the prior art.
Figure 8B:
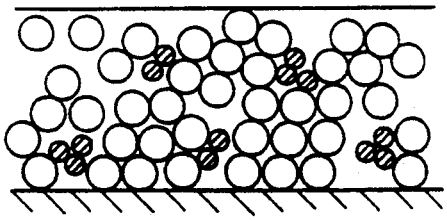
FIG. 8(b) PRIOR ART
Figure 8C:
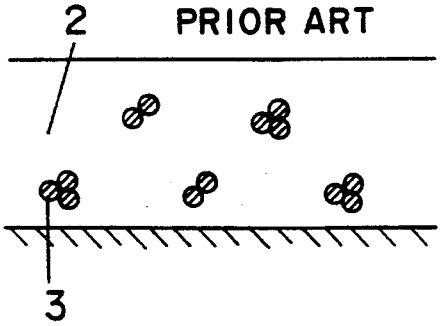
FIG. 8(c) PRIOR ART

However, it is difficult to apply the paint by the apparatus of FIG. 6 since paint 9 is applied to the lower surface of substrate 1. This problem can be solved, for example, by an apparatus as shown in FIG. 7. The paint application itself becomes easy by applying paint to the upper surface of substrate 1. The solvent contact step can be directed continuously, and the solvent contact step is achieved with extremely little disturbance to the surface of the coating layer.

The solvent contact step may be realized, aside from the above means, also by means of directly bringing the liquid surface of the solvent near the coating layer. However, in this technique, as compared with the technique of using the cloth sheet, homogeneous solvent contact on the whole surface of the coating layer is difficult, and the liquid surface varies as the solvent is evaporated, so that it is difficult to keep the gap between the surface of the solvent and the coating layer at a uniform distance.

Besides, by adjusting the temperature—providing a hot plate 17 near substrate 1 in the solvent contact part or cloth sheet 10—the time required for the solvent contact step may be shortened.

Practical embodiments of the invention are described below.

EXAMPLE 1

The following water-based emulsion dispersion of matrix polymer 2 and water-based emulsion dispersion of organic crystal particles 3 were used.

| | |
|---|---|
| (A) Water-based emulsion dispersion of matrix polymer 2: | |
| (1) Water-based emulsion dispersion of vinyl chloride-vinyl acetate-vinyl methanol amine copolymer resin (using dodecyl benzene sulfonic sodium as emulsifier, solid content 50%) | 100 parts |
| (B) Water-based emulsion dispersion of organic crystal particles 3: | |
| (1) Erucic amide | 17 parts |
| (2) n-Propanol | 17 parts |
| (3) Ethylene glycol monoethyl ether | 17 parts |
| (4) Purified water | 51 parts |

A water-based emulsion paint A was prepared by mixing and stirring 100 parts of the water-based emulsion dispersion of matrix polymer 2 and 102 parts of the water-based emulsion dispersion of organic crystal particles 3.

This paint was applied 200 μm thick in the coating step for a substrate 1, made of transparent polyethylene terephthalate sheet, and was dried for 2 minutes by warm air at 50° C., below the minimum film-forming temperature of the water-based emulsion dispersion of matrix polymer 2, in the provisional drying step to form a coating layer. The coating layer was immersed in warm water at 80° C. adjusted to pH 7 in the solvent contact step for at least five minutes. Afterwards, on a hot plate at 130° C., a 10 μm thick reversible thermal recording layer 5 was formed in the drying step.

On reversible thermal recording layer 5, an acrylic ultraviolet setting resin was formed as a protective layer 6 3 μm thick, and was cured by irradiation with ultraviolet rays.

In the following Examples 2 to 15 and Comparative Examples 1 to 3, support material 1 and protective layer 6 were of the same material and properties as in Example 1, while the paint and the manufacturing condition of reversible thermal recording layer 5 were varied as follows, and respective reversible thermal recording media were prepared.

EXAMPLE 2

The same coating layer as in Example 1 was immersed in a mixed solution of water/tetrahydrofuran=90/10 volume at 20° C. in the solvent contact step for three minutes. Afterwards, by drying on a hot plate at 130° C., a reversible thermal recording layer 5 of 10 μm in thickness was prepared.

EXAMPLE 3

The same coating layer as in Example 1 was immersed in ethyl acetate at 20° C. in the solvent contact step for thirty seconds. Afterwards, by drying on a hot plate at 130° C., a reversible thermal recording layer 5 of 10 μm in thickness was prepared.

EXAMPLE 4

The same coating layer as in Example 1 was immersed in tetrahydrofuran at 20° C. in the solvent contact step for thirty seconds. Afterwards, by drying on a hot plate at 130° C., a reversible thermal recording layer 5 of 10 μm in thickness was prepared.

EXAMPLE 5

The same coating layer as in Example 1 was contacted with a saturated vapor of tetrahydrofuran in an enclosed container at 20° C. in the solvent contact step for at least three minutes. Afterwards, by drying on a hot plate at 130° C., a reversible thermal recording layer 5 of 10 μm in thickness was prepared.

EXAMPLE 6

The same coating layer as in Example 1 was immersed in a saturated vapor of acetone in an enclosed container at 20° C. in the solvent contact step for at least five minutes. Afterwards, by drying on a hot plate at 130° C., a reversible thermal recording layer 5 of 10 μm in thickness was prepared.

EXAMPLE 7

The same water-based emulsion paint A as in Example 1 was applied on the substrate 1 in the coating step, and substrate 1 was then dried by hot air at 130° C. to form a continuous coating layer. This coating layer was treated in the solvent contact step under the same conditions as in Example 1. The effect was small when the contact time was five minutes, and 15 minutes was required. Afterwards, by drying on a hot plate at 130° C., a reversible thermal recording layer 5 of 10 μm in thickness was prepared.

EXAMPLE 8

The same continuous coating layer as in Example 7 was treated in the solvent contact step in the same condition as in Example 5, but the effect was small when the contact time was three minutes, and 10 minutes was required. Afterwards, by drying on a hot plate at 130° C., a reversible thermal recording layer 5 of 10 μm in thickness was prepared.

EXAMPLE 9

The following water-based emulsion dispersion of matrix polymer 2 and water-based emulsion dispersion of organic crystal particles 3 were used.

| | |
|---|---|
| (A) Water-based emulsion dispersion of matrix polymer 2: | |
| (1) Water-based emulsion dispersion of vinyl chloride-vinyl acetate-vinyl methanol amine copolymer resin (using dodecyl benzene sulfonic sodium as emulsifier, solid content 50%) | 100 parts |
| (B) Water-based emulsion dispersion of organic crystal particles 3: | |
| (1) Erucic amide | 17 parts |
| (2) Dodecyl benzene sulfonic sodium | 2 parts |
| (3) Purified water | 51 parts |

A water-based emulsion paint B was prepared by mixing and stirring 100 parts of water-based emulsion dispersion of matrix polymer 2 and 70 parts of water-based emulsion dispersion of organic crystal particles 3.

This paint was applied to a substrate 1 in the coating step and dried for 2 minutes by warm air at 50° C., below the minimum film-forming temperature of the water-based emulsion dispersion of matrix polymer 2, in the provisional drying step to form a coating layer. Substrate 1 was then treated under the same conditions as in Example 5 in the solvent contact step, and contact for at least five minutes was required. Afterwards, by drying on a hot plate of 130° C., a 10 μm thick reversible thermal recording layer 5 was formed on substrate 1.

EXAMPLE 10

The following water-based emulsion dispersion of matrix polymer 2 and water-based emulsion dispersion of organic crystal particles 3 were used.

| | |
|---|---|
| (A) Water-based emulsion dispersion of matrix polymer 2: | |
| (1) Water-based emulsion dispersion of vinyl chloride-vinyl acetate-vinyl methanol amine copolymer resin (using dodecyl benzene sulfonic sodium as emulsifier, solid content 50%) | 100 parts |
| (B) Water-based emulsion dispersion of organic crystal particles 3: | |
| (1) Erucic amide | 7 parts |
| (2) n-Propanol | 17 parts |
| (3) Purified water | 51 parts |

A water-based emulsion paint C was prepared by mixing and stirring 100 parts of the water-based emulsion dispersion of matrix polymer 2 and 85 parts of the water-based emulsion dispersion of organic crystal particles 3.

This paint was applied to a substrate 1 in the coating step, and dried for 2 minutes by warm air at 50° C., below the minimum film-forming temperature of the water-based emulsion dispersion of matrix polymer, in the provisional drying step to form a coating layer. Substrate 1 was then treated under the same conditions as in Example 5 in the solvent contact step, and at least five minutes was required for the contact step. Afterwards, by drying on a hot plate of 130° C., a 10 μm thick reversible thermal recording layer 5 was formed on substrate 1.

EXAMPLE 11

The following water-based emulsion dispersion of matrix polymer 2 and water-based emulsion dispersion of organic crystal particles 3 were used.

| | |
|---|---|
| (A) Water-based emulsion dispersion of matrix polymer 2: | |
| (1) Water-based emulsion dispersion of vinyl chloride-vinyl acetate-vinyl methanol amine copolymer resin (using dodecyl benzene sulfonic sodium as emulsifier, solid content 50%) | 100 parts |
| (B) Water-based emulsion dispersion of organic crystal particles 3: | |
| (1) Erucic amide | 17 parts |
| (2) n-Propanol | 17 parts |
| (3) n-Butanol | 17 parts |
| (4) Purified water | 51 parts |

A water-based emulsion paint D was prepared by mixing and stirring 100 parts of the water-based emulsion dispersion of matrix polymer 2 and 102 parts of the water-based emulsion dispersion of organic crystal particles 3.

This paint was applied to a substrate 1 in the coating step, and dried for 2 minutes by warm air at 50° C., below the minimum film-forming temperature of the water-based emulsion dispersion of matrix polymer, in the provisional drying step to form a coating layer. Substrate 1 was then treated under the same conditions as in Example 5 in the solvent contact step, and at least three minutes was required for the contact step. Afterwards, by drying on a hot plate of 130° C., a 10 μm thick reversible thermal recording layer 5 was formed on substrate 1.

EXAMPLE 12

15.0 g of vinyl chloride/vinyl acetate copolymer as matrix polymer 2, and 5.0 g of erucic amide as organic crystal particles 3, were dissolved and kneaded at 150° C. The mixture was cooled to liquid nitrogen temperature, and ground and pulverized. It was emulsified in 40.0 g of water in sodium dodecyl benzene sulfonate, and a water-based emulsion paint E was prepared.

This paint was applied to a substrate 1 in a coating step, and dried for 2 minutes by warm air at 50° C., below the minimum film-forming temperature of the water-based emulsion dispersion of matrix polymer, in the provisional drying step to form a coating layer. Substrate 1 was treated under the same conditions as in Example 5 in the solvent contact step, and at least five minutes was required for the contact step. Afterwards, by drying on a hot plate of 130° C., a 10 μm thick reversible thermal recording layer 5 was formed on substrate 1.

EXAMPLE 13

The following water-based emulsion dispersion of matrix polymer 2 and water-based emulsion dispersion of organic crystal particles 3 were used.

| | |
|---|---|
| (A) Water-based emulsion dispersion of matrix polymer 2: | |
| (1) Polyester resin | 100 parts |
| (2) Ethylene glycol mono-n-butyl ether | 30 parts |
| (3) Purified water | 170 parts |
| (B) Water-based emulsion dispersion of organic crystal particles 3: | |
| (1) Erucic amide | 17 parts |
| (2) n-Propanol | 17 parts |
| (3) Ethylene glycol monoethyl ether | 17 parts |
| (4) Purified water | 51 parts |

A water-based emulsion paint F was prepared by mixing and stirring 150 parts of the water-based emulsion dispersion of matrix polymer 2 and 102 parts of the water-based emulsion dispersion of organic crystal particles 3.

This paint was applied in a coating step to a substrate 1, and dried for 2 minutes by warm air at 50° C., below the minimum film-forming temperature of the water-based emulsion dispersion of matrix polymer, in the provisional drying step to form a coating layer. Substrate 1 was then treated under the same conditions as in Example 5 in the solvent contact step, and at least three minutes was required for the contact step. Afterwards, by drying on a hot plate of 130° C., a 10 μm thick reversible thermal recording layer 5 was formed on substrate 1.

EXAMPLE 14

The following organic solvent paint G was prepared.

| | |
|---|---|
| (1) Vinyl chloride-vinyl acetate copolymer | 100 parts |
| (2) Erucic amide | 33 parts |
| (3) Toluene/methyl ethyl ketone (= 1/1 volume) | 533 parts |

In this example, since the erucic amide was not completely dissolved in toluene/methyl ethyl ketone, a ball mill was used for dispersing the fine particles.

This paint was applied to a substrate 1 in a coating step, and dried by hot air at 120° C. to form a coating layer. The coating layer was treated for at least three minutes in the saturated vapor of tetrahydrofuran in an enclosed container at 20° C. Tetrahydrofuran was used as a solvent in the solvent contact step. Then, by drying on a hot plate at 150° C., a 10 μm thick reversible thermal recording layer 5 was formed on substrate 1.

EXAMPLE 15

While using the same coating layer as in Example 1 and the apparatus shown in FIG. 7, a nonwoven cloth impregnated with tetrahydrofuran and the coating layer were set face to face across a gap of 1 cm in the solvent contact step for 30 seconds. By drying with hot air at 130° C., a 10 μm thick reversible thermal recording layer 5 was formed on substrate 1.

COMPARATIVE EXAMPLE 1

Water-based emulsion paint A was applied on a substrate 1, and dried by hot air at 130° C. to form a continuous film. A 10 μm thick reversible thermal recording layer 5 was formed on substrate 1 without resort to a solvent contact step.

COMPARATIVE EXAMPLE 2

Water-based emulsion paint G was applied on a substrate 1, and dried by hot air at 130° C. A 10 μm thick reversible thermal recording layer 5 was formed on substrate 1 without resort to a solvent contact step.

COMPARATIVE EXAMPLE 3

While using the same coating layer as in Example 1, the liquid surface of tetrahydrofuran was set opposite to the surface of the coating layer across a gap of 1 cm.

The solvent contact step was conducted for 30 seconds. After the solvent contact step, dew condensation marks of tetrahydrofuran not experienced in Example 13 were observed on the surface of the coating layer in several locations for each area of 1 $m^2$.

The sections of the reversible thermal recording media in Examples 1 to 6 and Comparative Examples 1 and 2 were observed by a scanning electron microscope, and the rates of pores 4A or gaps 4B occupying the reversible thermal recording layer were measured as porosity.

In Example 1, organic crystal particles 3 of about 5 μm were dispersed in matrix polymer 2. In matrix polymer 2, also, multiple pores 4A of about 1 μm were observed. The porosity was about 10 vol. %.

In Example 2, organic crystal particles 3 of about 5 μm were dispersed in matrix polymer 2. In matrix polymer 2, also, multiple pores 4A of about 1 μm were observed, and multiple gaps 4B of about 0.1 μm in width were observed in the interfaces between organic crystal particles 3 and matrix 2. The porosity was about 10 vol. %.

In Examples 3 and 4, organic crystal particles 3 of about 1 μm were dispersed in matrix polymer 2. In matrix polymer 2, also, multiple pores 4A of about 1 μm were observed, and gaps 4B of about 0.1 μm in width were observed in the interfaces between organic crystal particles 3 and matrix 2. The porosity was about 13 vol. %.

In Examples 5 and 6, organic crystal particles 3 of about 1 μm were dispersed in the matrix polymer 2. Multiple gaps 4B of about 0.1 μm in width were observed in the interfaces between organic crystal particles 3 and matrix 2. The porosity was about 5 vol. %.

In Comparative Example 1, organic crystal particles 3 of about 5 μm were dispersed in matrix polymer 2, but pores 4A and gaps **4*b* were hardly observed at all. In Comparative Example 2, organic crystal particles 3 of about 3μ were dispersed in matrix polymer 2, but pores 4A were not observed. Gaps 4B were observed only in the interface between part of the matrix polymer 2 and organic crystal particles 3**.

The transparent phase temperature range of the reversible thermal recording media of the examples and comparative examples was measured; all findings fell within the range of 75° to 80° C. The reversible thermal recording media manufactured in Examples 1 to 15 and Comparative Examples 1 to 3 were set in transparent state at 75° C., and in opaque state at 100° C.; the transparent states and opaque states of the reversible thermal recording media were measured by using reflection densitometer (MacBeth densitometer RD-918) in terms of colorimetric concentration on the standard black board. The results are recorded in Table 1.

The measurement by the reflection densitometer was 1.78 in the reflection concentration of the standard black board, and 0.05 in the standard white board. The value was smaller when the turbidity was higher, and larger when the transparency was higher. The visibility (or contrast) was evaluated by finding the difference in measurements between the transparent state and opaque state.

TABLE 1

| Sample No. | Evaluation Time | | |
|---|---|---|---|
| | Transparent State | Opaque State | Visibility |
| Example 1 | 1.53 | 0.61 | 0.92 |
| Example 2 | 1.55 | 0.53 | 1.02 |
| Example 3 | 1.55 | 0.50 | 1.05 |
| Example 4 | 1.56 | 0.41 | 1.15 |
| Example 5 | 1.65 | 0.45 | 1.20 |
| Example 6 | 1.64 | 0.76 | 0.88 |
| Example 7 | 1.55 | 0.80 | 0.75 |
| Example 8 | 1.63 | 0.78 | 0.85 |
| Example 9 | 1.65 | 0.67 | 0.98 |
| Example 10 | 1.66 | 0.65 | 1.01 |
| Example 11 | 1.67 | 0.62 | 1.05 |
| Example 12 | 1.65 | 0.40 | 1.25 |
| Example 13 | 1.52 | 0.55 | 0.97 |
| Example 14 | 1.63 | 0.43 | 1.20 |
| Example 15 | 1.64 | 0.45 | 1.19 |
| Comparative Ex. 1 | 1.61 | 1.06 | 0.56 |
| Comparative Ex. 2 | 1.52 | 0.71 | 0.81 |
| Comparative Ex. 3 | 1.63 | 0.45 | 1.18 |

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description and all changes which come within the meaning and range of equivalency of the claims are intended to be embraced therein.

We claim:

1. A reversible thermal recording medium having a reversible thermal recording layer on a substrate, reversibly showing a transparent state and opaque state respectively by cooling after two modes of heating, wherein said reversible thermal recording layer is porous and comprises organic crystal particles dispersed in a matrix polymer.

2. A reversible thermal recording medium of claim 1, wherein the pores of said reversible thermal recording layer are formed in said matrix polymer.

3. A reversible thermal recording medium of claim 2, wherein the mean pore size of said pores is from 0.1 μm to 10 μm.

4. A reversible thermal recording medium of claim 1, wherein the porosity of said reversible thermal recording layer is from 5 vol. % to 50 vol. %.

5. A reversible thermal recording medium of claim 1, wherein said reversible thermal recording layer comprises gaps formed in the interfaces of said organic crystal particles and said matrix polymer.

6. A reversible thermal recording medium of claim 5, wherein the mean particle size of said organic crystal particles is 3 μm or less.

7. A reversible thermal recording medium of claim 5, wherein the mean width of said gaps formed in said reversible thermal recording layer is 1 μm or less.

* * * * *